US006543954B2

(12) United States Patent
Owings

(10) Patent No.: US 6,543,954 B2
(45) Date of Patent: Apr. 8, 2003

(54) PUMP SUN-SCREEN LOTION DISPENSER & APPLICATOR FOR THE BACK

(76) Inventor: Eric John Owings, 3456 Meridale Dr., Las Vegas, NV (US) 89117

( * ) Notice: Subject to any disclaimer, the term of this patent is extended or adjusted under 35 U.S.C. 154(b) by 0 days.

(21) Appl. No.: 09/900,689

(22) Filed: Jul. 9, 2001

(65) Prior Publication Data

US 2002/0018687 A1 Feb. 14, 2002

Related U.S. Application Data

(60) Provisional application No. 60/216,946, filed on Jul. 10, 2000.

(51) Int. Cl.[7] ..... B43M 11/06
(52) U.S. Cl. ..... 401/185; 401/6; 401/188 R
(58) Field of Search ..... 401/6, 188 R, 401/185, 205, 196, 187

(56) References Cited

U.S. PATENT DOCUMENTS

| | | | | | |
|---|---|---|---|---|---|
| 2,800,673 | A | * | 7/1957 | Lazisky | 401/6 |
| 5,931,591 | A | * | 8/1999 | McCracken | 401/6 |
| 6,129,469 | A | * | 10/2000 | Messer et al. | 401/6 |
| 6,247,862 | B1 | * | 6/2001 | Garza | 401/6 |
| 6,261,014 | B1 | * | 7/2001 | Altobellis et al. | 401/6 |

* cited by examiner

*Primary Examiner*—David J. Walczak
(74) *Attorney, Agent, or Firm*—Craig Weiss; Harry M. Weiss; Weiss, Moy & Harris, P.C.

(57) ABSTRACT

A pump-activated lotion dispenser and applicator capable of dispensing lotion into an applicator pad and applying lotion onto the skin of a person. The pump-activated lotion dispenser and applicator uses a squeeze bulb pump and is capable of one-hand use.

9 Claims, 2 Drawing Sheets

PUMP SUN-SCREEN LOTION DISPENSER & APPLICATOR FOR THE BACK

RELATED APPLICATIONS

This application claims priority to a corresponding provisional application U.S. Ser. No. 60/216,946, filed Jul. 10, 2000 in the name of the applicant of this application.

FIELD OF THE INVENTION

This invention relates generally to lotion dispensers and applicators and, more specifically, to a hand-held pump-activated lotion dispenser and applicator capable of dispensing lotion into an applicator pad and applying lotion onto the skin of a person.

BACKGROUND OF THE INVENTION

Many people apply various types of lotions to the body. Sun-screen, which protects the skin from ultraviolet rays, is often applied by individuals to protect themselves from this harmful radiation. Other lotions and skin creams are also applied to the body to treat dryness, burns, skin diseases and other ailments. It is often difficult for one to apply lotion to certain parts of one's body, such as the back. The result is often either uneven application of the lotion or no application at all.

Various lotion dispensers and applicators have been developed to address these problems. Many lotion dispensers rely on gravity to deliver the lotion onto an applicator head or use a siphon device built into the applicator head to pull the lotion/substance onto the applicator. Other lotion applicators apply lotion to the body in response to pressure placed on the applicator head. For example, U.S. Pat. No. 6,045,279 issued to Follis shows a lotion applicator which utilizes a floating pressure plate to create positive pressure in order to deliver the lotion. Having the activation and amount of lotion disbursal reliant on either gravity or the pressure applied to the applicator by the body is problematic. The result of lotion application in these prior art devices to often uneven and difficult to control application of the lotion.

A need therefore existed for a lotion dispenser and applicator having a bulb-shaped pump allowing for a more controlled way of applying lotion onto the skin.

SUMMARY OF THE INVENTION

An object of the present invention is to provide a lotion dispenser and applicator having a bulb-shaped pump handle capable of one-handed operation and allowing for a more controlled way of dispensing and applying lotion onto the skin.

It is a further object of the present invention to provide a lotion dispenser and applicator capable of more efficiently disbursing lotion through a reservoir and into an applicator pad.

DETAILED DESCRIPTION OF THE PREFERRED EMBODIMENTS

Figure 1:
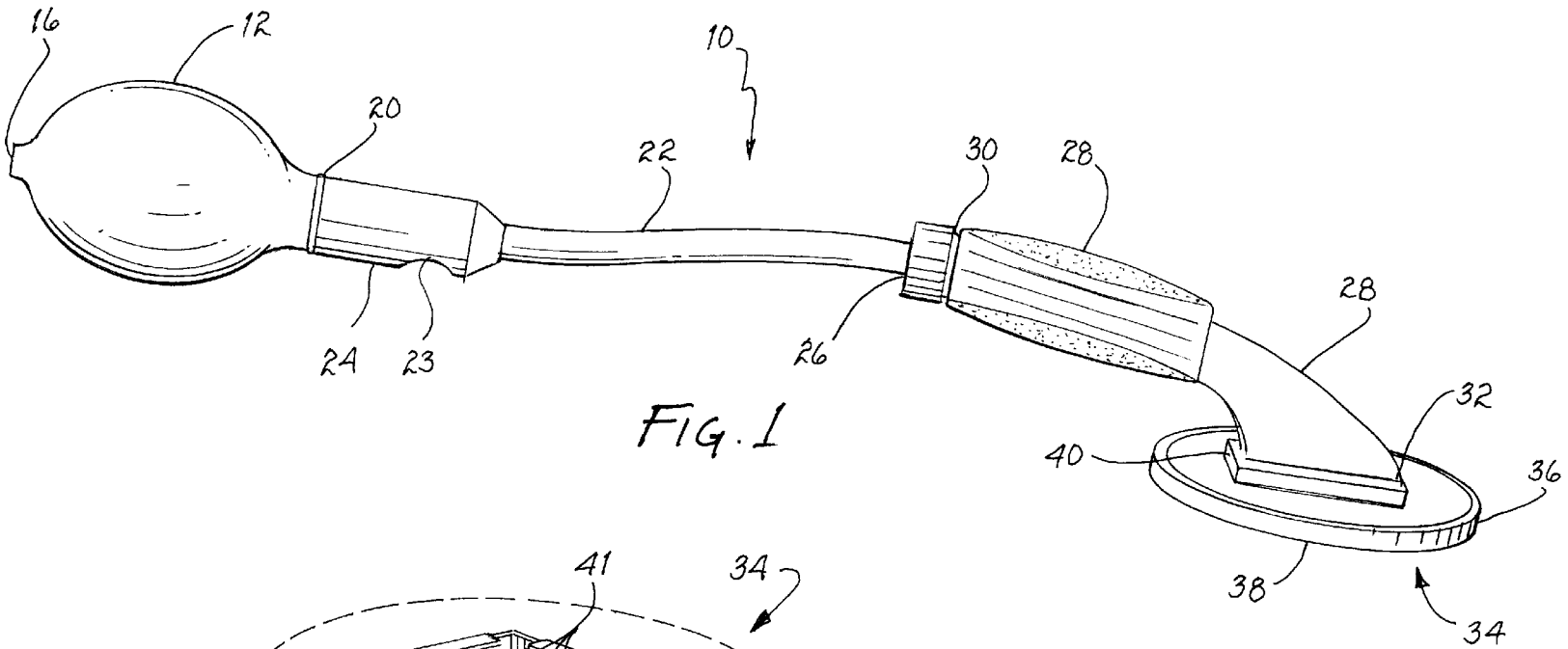
FIG. 1 is a perspective view of the pump-activated lotion dispenser and applicator of the present invention.
Figure 2:
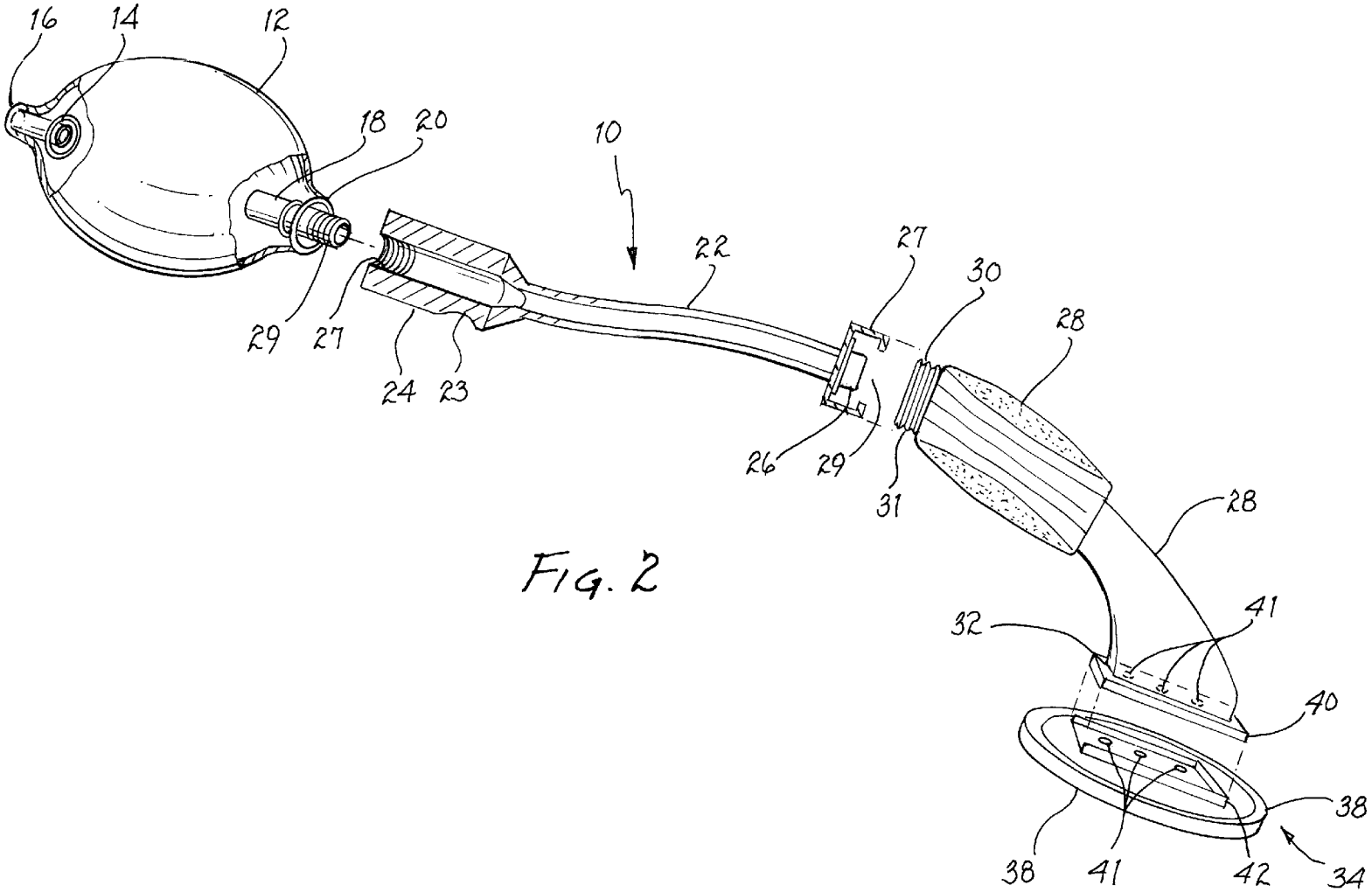
FIG. 2 is a perspective, partially exploded view of the pump-activated lotion dispenser and applicator of FIG. 1.

Referring to FIGS. 1–2, the pump-activated lotion dispenser and applicator of the present invention, hereinafter pump-activated lotion dispenser and applicator 10, is shown. The pump-activated lotion dispenser and applicator 10 is comprised of a squeeze bulb pump 12 having an inlet check valve 14 (shown in FIG. 2) at a first end 16 and an outlet check valve 18 (shown in FIG. 2) at a second end 20. The inlet check valve 14 is dimensioned to admit air into the squeeze bulb pump 12. The outlet check valve 18 is dimensioned to permit air to exit the squeeze bulb pump 12 while at the same time preventing a back flow of air from entering the squeeze bulb pump 12.

Still referring to FIGS. 1–2, the pump-activated lotion dispenser and applicator 10 comprises a reservoir adapter 22. The reservoir adapter 22 has an upstream end 24 and a downstream end 26 and a longitudinal bore therethrough. The upstream end 24 is coupled to the second end 20 of the squeeze bulb pump 12 and dimensioned to receive air from the outlet check valve 18. In one embodiment, the upstream end 24 of the reservoir adapter 22 defines a threaded aperture 27 (shown in FIG. 2) that is dimensioned to mate with a corresponding hollow threaded screw 29 (shown in FIG. 2) located on the second end 20 of the squeeze bulb pump 12, although it should be clear that substantial benefit could be derived from an alternative embodiment of the present invention in which there is no threaded aperture 27 and there is no threaded screw 29, so long as there is a mechanism for securely coupling the second end 20 of the squeeze bulb pump 12 to the upstream end 24 of the reservoir adapter 22 while maintaining positive air flow, such as by a snap-type coupling mechanism.

In the preferred embodiment, the upstream end 24 of the reservoir adapter 22 is contoured to allow for a thumb of a person (not shown) to rest in a recessed portion 23 thereof, although it should be clearly understood that substantial benefit could be derived from an alternative configuration of the pump-activated lotion dispenser and applicator 10 in which there is no recessed portion 23 for a thumb of a person.

Still referring to FIGS. 1–2, the pump-activated lotion dispenser and applicator 10 further comprises a reservoir 28 dimensioned to be filled with a lotion-type substance (not shown). The reservoir 28 has an upstream end 30 and a downstream end 32. The upstream end 30 of the reservoir 28 is coupled to the downstream end 26 of the reservoir adapter 22. Preferably, the upstream end 30 of the reservoir 28 is detachably coupled to the downstream end 26 of the reservoir adpater 22 in order to more easily allow the reservoir 28 to be filled with a lotion-type substance, although it should be clearly understood that substantial benefit could be derived from an alternative configuration of the pump-activated lotion dispenser and applicator 10 in which the reservoir 28 is fixedly coupled to the reservoir adapter 22 (such an embodiment might have a reservoir 28 which defines an aperture dimensioned to be used for filling the reservoir 28 with lotion).

Preferably, the downstream end 26 of the reservoir adapter 22 comprises a flange 27 (preferably made of a semi-flexible rubber) defining a threaded aperture 29 therethrough dimensioned to mate with a corresponding hollow threaded screw 31 located on the upstream end 30 of the reservoir 28. While, in the preferred embodiment the downstream end 26 of the reservoir adpater 22 comprises a flange 27 defining a threaded aperture 29 dimensioned to mate with a screw 31, it should be clearly understood that substantially benefit could be derived from an alternative configuration of the pump-activated lotion dispenser and applicator 10 in which an alternative coupling mechanism is used to secure the reservoir adapter 22 to the reservoir 28, such as a snap-type coupling mechanism.

In the preferred embodiment, the pump-activated lotion dispenser and applicator 10 is comprised of high impact injection molded thermal plastic construction, although it should be clearly understood that substantial benefit could be derived from an alternative configuration of the pump-activated lotion dispenser and applicator 10 in which the pump-activated lotion dispenser and applicator 10 is constructed of another material, so long as the component parts are capable of being securely coupled to one another.

Figure 3:
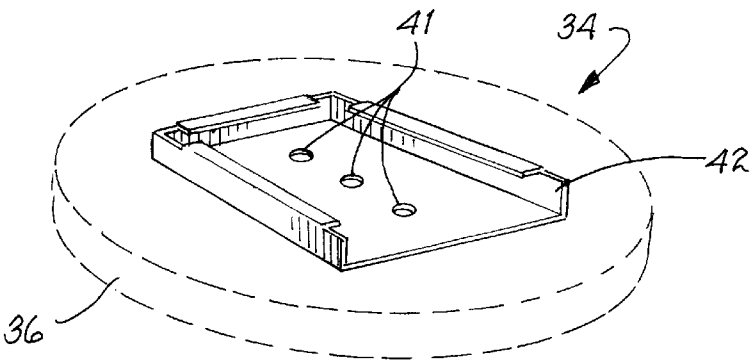
FIG. 3 is a perspective view of the applicator head of the pump-activated lotion dispenser and applicator of FIG. 1.

Referring now to FIGS. 1–3, the pump-activated lotion dispenser and applicator 10 further comprises an applicator pad 34 attached proximate the downstream end 32 of the reservoir 28. The applicator pad 34 is dimensioned to secrete lotion to a body area of a person (not shown) when the squeeze bulb pump 12 is activated. Preferably, the applicator pad 34 is comprised of a porous sponge 36 covered in a substantially terry cloth fabric 38, although it should be clearly understood that substantial benefit could be derived from an alternative configuration of the pump-activated lotion dispenser and applicator 10 in which the applicator pad 34 is comprised of other materials so long as the applicator pad 34 is capable of secreting lotion in a controlled way.

In the preferred embodiment, a flange 40 is coupled to the downstream end 32 of the reservoir 28. The flange 40 preferably defines three apertures 41 (shown in FIG. 2) having a diameter of substantially ⅛ inch. Preferably, the pump-activated lotion dispenser and applicator 10 further comprises a mounting bracket 42 having a first side coupled to the applicator pad 34 and a second side dimensioned to be coupled to the flange 40. The mounting bracket 42 preferably defines three apertures 41 (shown in FIGS. 2–3) having a diameter of substantially ⅛ inch corresponding to the three apertures 41 defined by the flange 40. When the mounting bracket 42 is coupled to the flange 40, the three apertures 41 of the flange 40 are dimensioned to pass lotion from the reservoir 28 through the three apertures 41 of the mounting bracket 42 and into the applicator pad 34. Preferably, the mounting bracket 42 is dimensioned to slidably lock onto the flange 40 of the downstream end 32 of the reservoir 28 for easy attachment and removal, although it should be clearly understood that substantial benefit could be derived from an alternative configuration of the pump-activated lotion dispenser and applicator 10 in which the applicator pad 34 is coupled to the reservoir 28 by some other means, such as integrally as part of a one-piece assembly.

In the preferred embodiment, the downstream end 32 of the reservoir 28 is contoured, so as to allow the surface of the applicator pad 34 to be parallel to the length of the reservoir adapter 22. In this way, a person holding the squeeze bulb pump 12 can more easily apply the applicator pad 34 to the skin of a person, although it should be clearly understood that substantial benefit could be derived from an alternative embodiment of the pump-activated lotion dispenser and applicator 10 in which the reservoir 28 is contoured in a different direction or not contoured at all.

STATEMENT OF OPERATION

In order to use the pump-activated lotion dispenser and applicator 10 one must first fill the reservoir 28 with a lotion-type substance. If the pump-activated lotion dispenser and application 10 is not already assembled, then the second end 20 of the squeeze bulb pump 12 must be coupled to the upstream end 24 of the reservoir adapter 22. The downstream end 26 of the reservoir 22 must be coupled to the upstream end 30 of the reservoir 28. The applicator pad 34 must then be coupled to the downstream end 32 of the reservoir 28. One must then place a hand over the squeeze bulb pump 12. Preferably placing the thumb in the recessed portion 23 of the upstream end 24 of the reservoir adapter 22. Repeated squeezing and releasing of the squeeze bulb pump 12 draws air into the inlet check valve 14 and out the outlet check valve 18. The air then travels through the upstream end 24 of the reservoir adapter 22 and out the downstream end 26 of the reservoir adpater 22. The air then enters the upstream end 30 of the reservoir 28 and comes into contact with the lotion-type substance. The pressure of the air will force the lotion-type substance down the reservoir 28 and out the downstream end 32 of the reservoir 28. The lotion-type substance will then preferably pass through the three apertures 41 in the flange 40 and through the three apertures 41 in the mounting bracket 42 into the applicator pad 34. The lotion-type substance will seep into the sponge 36 and onto a body surface of a person when the applicator pad 34 is proximate the skin of a person.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A pump-activated lotion dispenser and applicator comprising, in combination:

a squeeze bulb pump comprising a squeeze bulb for only containing air and having an inlet check valve at a first end and an outlet check valve at a second end, said inlet check valve is dimensioned to admit air into said squeeze bulb pump and said outlet check valve is dimensioned to permit air to exit said squeeze bulb pump while at the same time said outlet check valve is dimensioned to prevent a back flow of air from entering said squeeze bulb pump;

a reservoir adapter for only conveying air and having an upstream end and a downstream end and a longitudinal bore therethrough, said upstream end is coupled to said second end of said squeeze bulb pump and dimensioned to receive air from said outlet check valve;

a reservoir dimensioned to be filled with a lotion-type substance and having an upstream end and a downstream end, said upstream end of said reservoir is coupled to said downstream end of said reservoir adpater and said upstream end of said reservoir is dimensioned to receive air from said downstream end of said reservoir adapter in order to force said lotion from said upstream end of said reservoir out of said downstream end of said reservoir;

an applicator pad attached proximate said downstream end of said reservoir, said applicator pad is dimensioned to secrete lotion to a body area of a person when said squeeze bulb pump is activated initiating an air flow from said first end of said squeeze bulb pump into said second end of said squeeze bulb pump and through said upstream end of said reservoir adapter and into said downstream end of said reservoir adapter and into said reservoir where said lotion-type substance is forced through said downstream end of said reservoir and into said applicator pad.

2. The pump-activated lotion dispenser and applicator of claim 1, wherein said upstream end of said reservoir adapter defines a threaded aperture dimensioned to mate with a corresponding hollow threaded screw located on said second end of said squeeze bulb pump.

3. The pump-activated lotion dispenser and applicator of claim 1 wherein said reservoir is detachable from said reservoir adapter.

4. The pump-activated lotion dispenser and applicator of claim 1 wherein said pump-activated lotion dispenser and applicator is comprised of high impact injection molded thermal plastic construction.

5. The pump-activated lotion dispenser and applicator of claim 1 further comprising:

a flange coupled proximate said downstream end of said reservoir; and a mounting bracket having a first side coupled to said applicator pad and a second side coupled to said flange.

6. The pump-activated lotion dispenser and applicator of claim 5 wherein said flange defines three apertures having a diameter of substantially ⅛ inch and said mounting bracket defines three corresponding apertures having a diameter of substantially ⅛ inch, said three apertures of said flange are dimensioned to pass lotion from said reservoir through said three apertures of said mounting bracket and into said applicator pad.

7. The pump-activated lotion dispenser and applicator of claim 1 wherein said upstream end of said reservoir adapter is contoured to allow for a thumb of a person to rest in a recessed portion thereof.

8. The pump-activated lotion dispenser and applicator of claim 1 wherein said downstream end of said reservoir adapter comprises a flange defining a threaded aperture therethrough dimensioned to mate with a corresponding hollow threaded screw located on said upstream end of said reservoir.

9. The pump-activated lotion dispenser and applicator of claim 1 wherein said applicator pad is comprised of a porous sponge covered in a substantially terry cloth fabric.

* * * * *